United States Patent [19]

Chen

[11] Patent Number: 4,762,029

[45] Date of Patent: Aug. 9, 1988

[54] BOTTLE CLOSURE OPENER

[75] Inventor: Joseph Chen, Quezon, Philippines

[73] Assignee: Isabelita Hilario Chen, Quezon, Philippines

[21] Appl. No.: 26,155

[22] Filed: Mar. 16, 1987

[30] Foreign Application Priority Data

Apr. 30, 1986 [PH] Philippines ..... 33719

[51] Int. Cl.[4] ..... B67B 7/18

[52] U.S. Cl. ..... 81/3.2; 81/3.32

[58] Field of Search ..... 81/3.2, 3.32, 3.31, 81/3.33; 53/317, 381 A, 381 R

[56] References Cited

U.S. PATENT DOCUMENTS 4,171,650 10/1979 Cardinal ..... 81/3.2

*Primary Examiner*—Roscoe V. Parker

[57] ABSTRACT

The bottle closure opener of the present invention has a bottle body cramping unit mounted on a vertically movable platform within a housing having an open front and a top wall, and a bottle cap gripping unit fixedly mounted on said top wall. The cramp members of the bottle body cramping unit and the grip member of the bottle cap gripping unit are simultaneously controlled by a single clutch switch lever which drivingly connects to a reversible motor through a single clutch unit to move said cramp members either towards or away from each other and said movable platform to move either upwardly or downwardly; and said grip members to rotate counterclockwise to effect the subsequent gripping and opening of the cap.

4 Claims, 9 Drawing Sheets

BOTTLE CLOSURE OPENER

The present invention relates in general to a bottle closure opener. More particularly, it relates to a bottle closure opener adapted for use on a jar or bottle with a screw cap.

This application is a copending application of my Philippine Patent application Ser. No. 33,719 filed Apr. 30, 1986 entitled "BOTTLE CLOSURE OPENER". In a related earlier copending Philippine patent application Ser. No. 32,338 filed May 30, 1985, the bottle body cramping unit is mounted on the base and supported by a coil spring to its highest position to accommodate a tall bottle, and the bottle cap gripping unit is vertically aligned with said body cramping unit. The grip on the bottle body by the V-shaped vise jaws is effected by a guide disk with cam guides and is controlled by a switch lever operably connected to a reversible motor through a clutch unit. Likewise, the grip on the bottle cap by the grip fingers of the bottle cap gripping unit is manually controlled by pressing a lever on said gripping unit which drivingly connects to a rotating helically threaded vertical shaft through a brake unit to push down said unit until the grip fingers frictionally bear on the bottle cap. In short, the bottle body cramping unit and the bottle cap gripping unit are independently controlled by a clutch unit and a brake unit, respectively. The bottle cap gripping unit is hand-pressed to effect a firm grip on the cap.

Briefly stated, the bottle closure opener of the present invention has its bottle body cramping unit mounted on a vertically movable platform within a housing with an open front and a top wall and the bottle cap gripping unit is fixedly mounted at said top wall of said housing. In contrast with my copending application, the grip on the bottle body cramping unit and the bottle cap gripping unit are simultaneously controlled by a single clutch switch lever which drivingly connects to a reversible motor through a single clutch unit.

It is, therefore the main object of the present invention to provide a bottle closure opener wherein the effective grip of the bottle body and cap therefor are simultaneously controlled by a single clutch switch lever and a single clutch unit to effect the subsequent opening of the cap.

A related object of the present invention is to provide a bottle closure opener wherein the opening of the bottle cap is simplified and made easier by merely pressing a single clutch switch lever and "Off-Hand" whereby the young and the old will encounter no difficulty during the cap opening operation.

Another object of the present invention is to provide a bottle closure opener which is versatile in use as it could be readily adapted to accommodate jars or bottles of various sizes, heights and shapes.

Yet, another object of the present invention is to provide a bottle closure opener for a screwtype bottle cap which is very effective and efficient in performance.

The above objects and advantages of the present invention will be fully appreciated and clearly understood upon the reading of the detailed description taken together with the accompanying drawings, wherein:

FIG. 6 is a front view similar to FIG. 5 showing the vise jaws positioned to clamp a large bottle;

Figure 1:
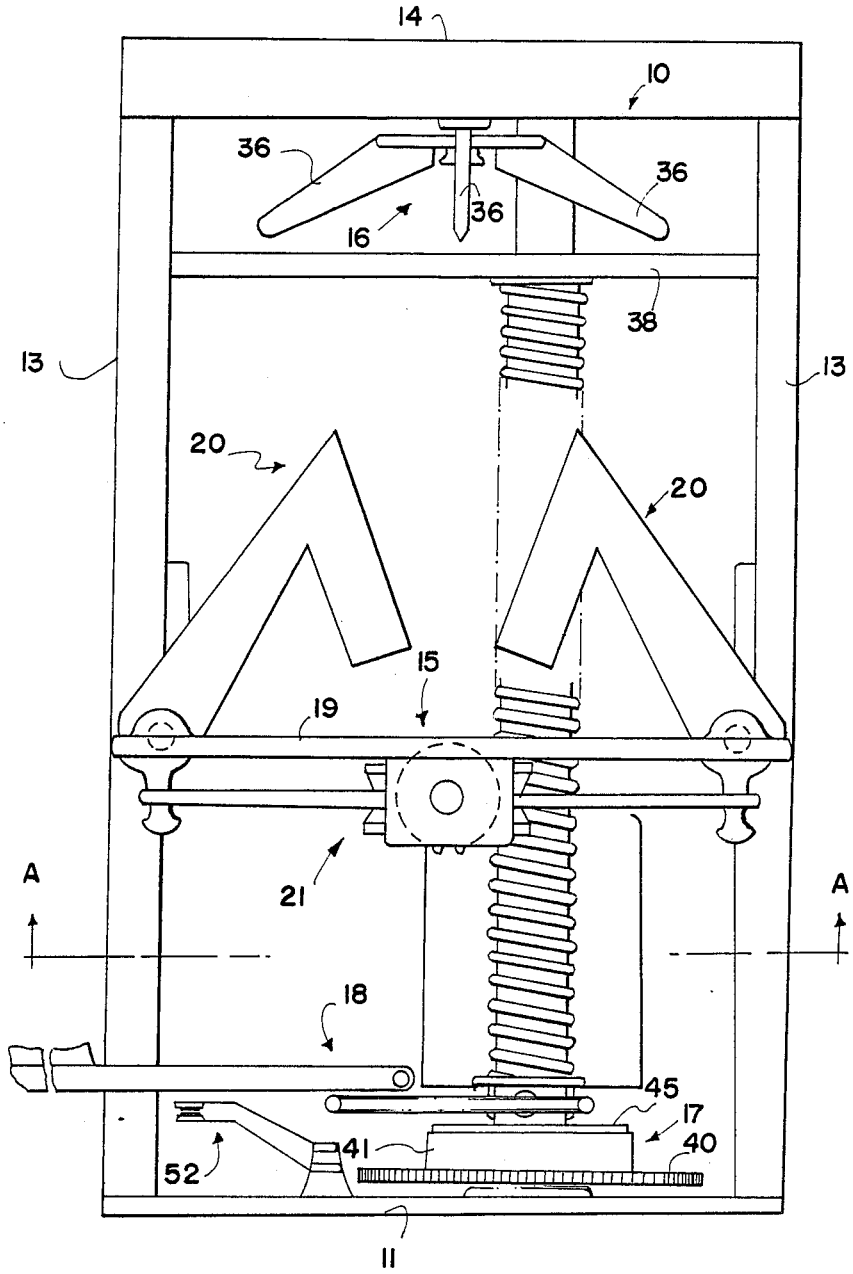
FIG. 1 is a front view of a bottle closure opener for a screw-type jar or bottle cap in accordance with the present invention.
Figure 2:
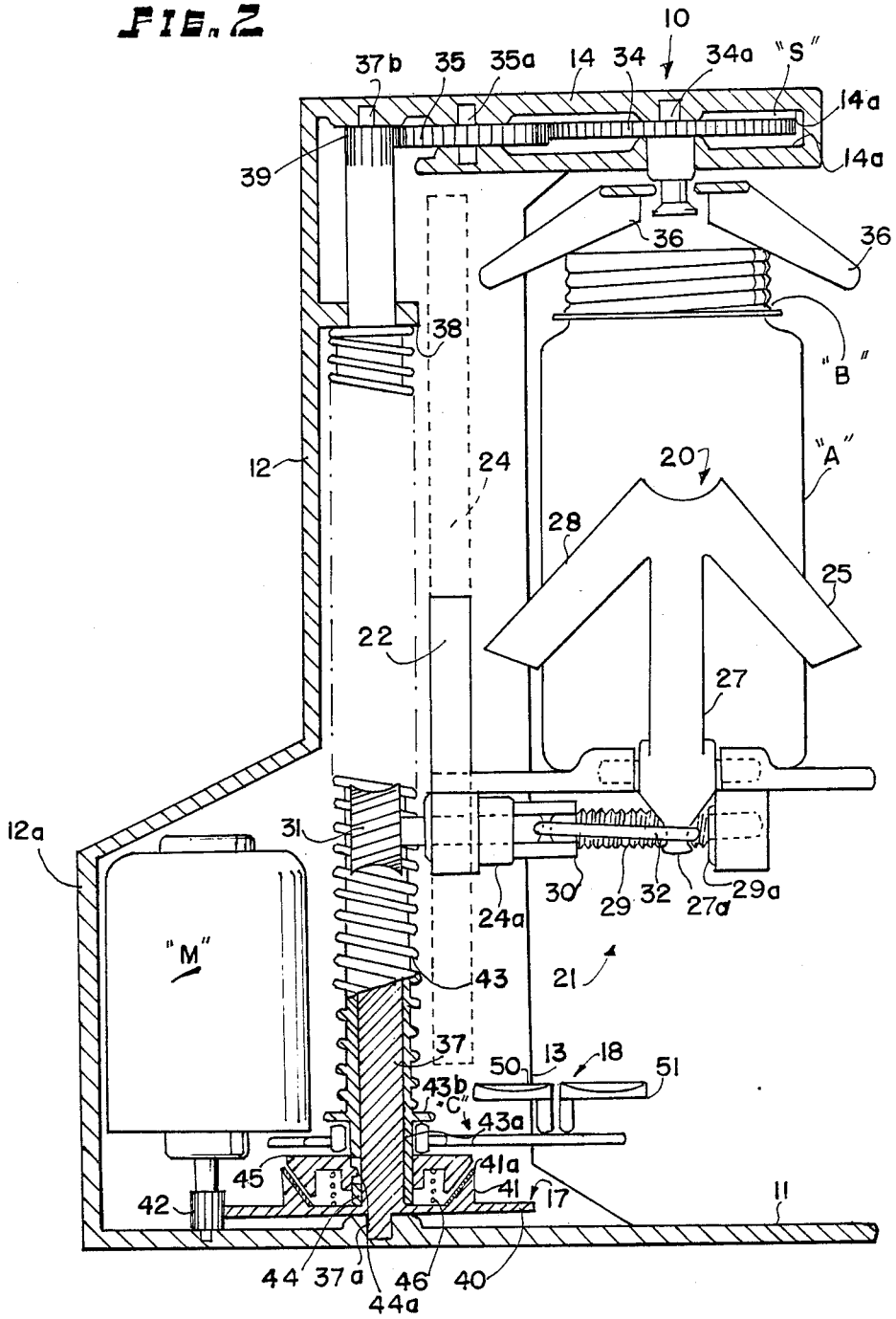
FIG. 2 is a vertical sectional view of a bottle closure opener of FIG. 1.

With reference to the drawings in detail, there is shown in FIG. 1 a bottle closure opener indicated in its entirety as 10 adapted to open a screw cap of a jar or bottle of different sizes, heights and shapes.

The bottle closure opener 10 includes a housing with an open front, a rectangular base 11, a rear wall 12 with an extended lower portion **12*a*, opposed side walls 13 and a top wall 14 having a spaced underside wall 14*a* to define a space "S" therebetween, bottle body cramping unit 15; a bottle cap gripping unit 16; a drive mechanism 17 and a clutch switch lever mechanism 18**.

The bottle body cramping unit 15 is comprised of a vertically slidable bottle platform 19, a pair of laterally opposed cramp members 20 and a means for actuating the cramp members 21.

Figure 7:
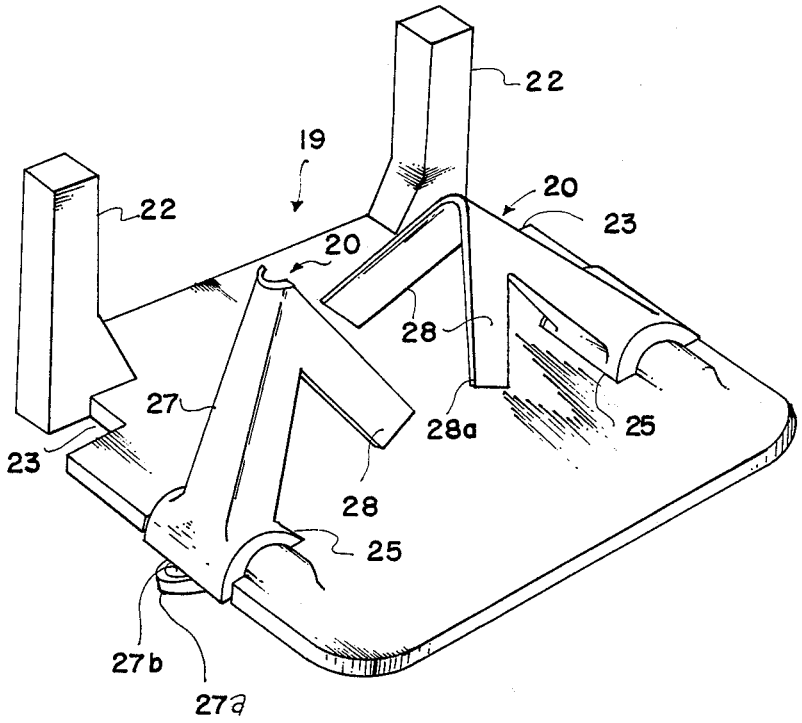
FIG. 7 is a perspective view of a bottle platform vertically slidable on the opposed sides of the housing.
Figure 8:
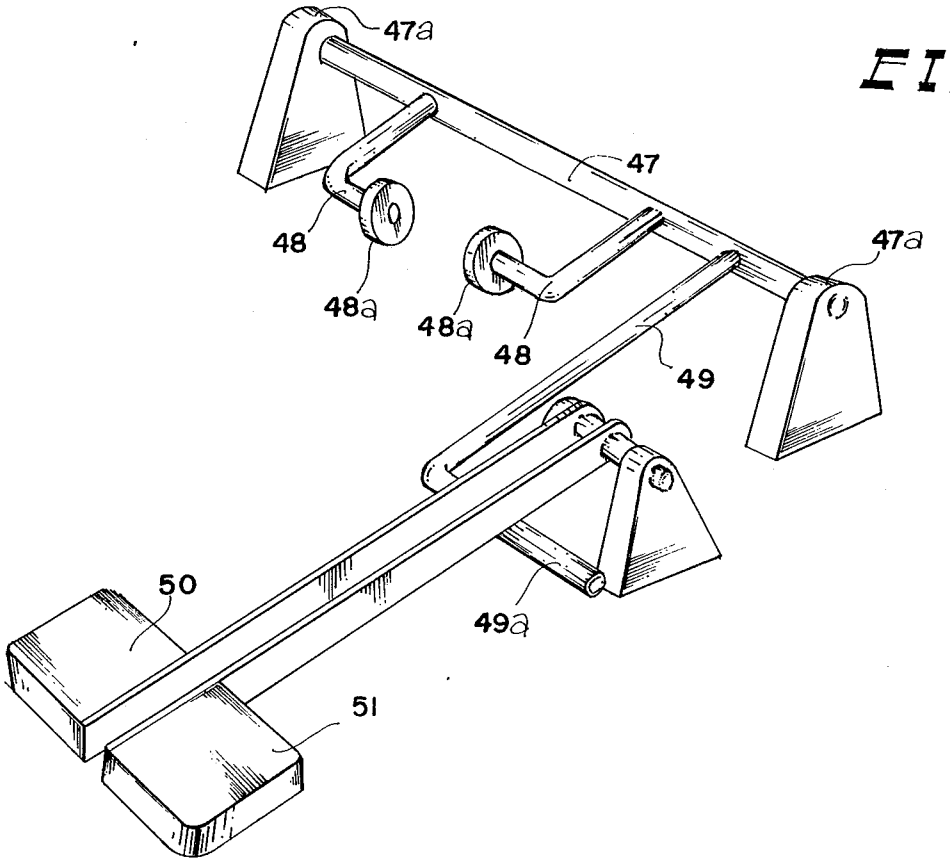

The bottle platform 19 (FIG. 7) has on its inner corners thereof a pair of vertical guide members 22 with an adjacent undercut 23 said guide member adapted to be slidably held in a snug-fit relation on the complemental grooves 24 vertically disposed on the outer ends of the side walls 13. At the lateral mid-section of said platform is provided with a pair of laterally opposed undercuts 25. A pair of cramp members 20 are disposed on said undercuts, said cramp members being pivotally held on said undercuts by means of horizontal pivot pins 26, with the lower end of said cramp members extending below the bottle platform.

Each of the cramp members 20 consists of an upwardly extending stem 27 having an inwardly bent rounded lower end **27*a* with a reduced portion 27*b*, and a pair of diverging downwardly inclined vise jaws 28 defining a V-shape formation. The vise jaws face each other and adapted to bow toward each other to firmly grip a bottle body "A". The underside of the jaws are provided with an elastic lining 28*a*** to effect a firm grip on the bottle body.

The actuating means 21 for the cramp members 20 comprises a horizontal threaded shaft 29 of predetermined length provided with an internally threaded block 30 threadedly engaged thereon, said shaft being positioned at the longitudinal mid-section underneath said bottle platform 19 and rotatably supported on spaced bushings **29*a*, the inner end of said shaft extending past the platform and with a worm gear 31 being keyed thereon. At the lateral ends of the threaded block 30 are pivotally supported thereon a pair of identical ram arms 32 dimensioned to extend proximate the edge of the movable platform and aligned with the lower ends 27*a* of the cramp members 20 when positioned in linear alignment with each other. The ends of said ram arms are provided with holes 33 adapted to freely receive therein in the reduced end portions 27b** of the lower end of the cramp members but of which preclude detachment therefrom when pushed or pulled, as the case may be, by the opposed ram arms.

The bottle cap gripping unit 16 is comprised of a gear train operably supported on the space "S" on the top wall 14, said gear train consisting of a large driven gear 34 keyed on a vertical stub shaft 34a journalled for rotation on said top wall, and vertically aligned with the center between the cramp members 20, and an idler gear 35 keyed on a shaft 35a in meshing relation with said gear 34. At the lower end of the stub shaft 34a is fixedly secured thereon downwardly inclined grip fingers 36 adapted to firmly grip and rotate to open the bottle cap "B".

The driving mechanism 17 comprises a vertical driven shaft 37 rotatably supported on the journals 37a, 37b at the base 11 and top wall 14, said shaft being held by a shaft holder 38 which is integrated on the rear wall. The driven shaft is provided at the upper end thereof with a small gear 39 adapted to be in mesh relation with the idler gear 35 of the gear train, and at the lower end is integrated with a large driven gear 40 having an integrated lower clutch member 41 provided with a clutch lining 41a. The driven gear 40 is meshed with the drive gear 42 keyed on the shaft of the reversible motor "M".

A helically threaded hollow shaft 43 is telescopically received on the driven shaft 37 with its upper end extending up to the shaft holder 38. The lower end of said threaded shaft has an unthreaded portion 43a of predetermined length with its upper end provided with an annular flange 43b. A vertical groove or keyway 44 is provided on said unthreaded portion. Telescopically received on said unthreaded hollow shaft portion is an upper clutch member 45 vertically aligned with the lower clutch member 41. Preferably, the lower and upper clutch members 41 and 45 are frusto-conically shaped whereby a better gripping effect could be attained. The upper clutch member 45 has a key 44a adapted to freely slide vertically on the keyway 44, whereby said upper clutch member will rotate in unison with the helically threaded hollow shaft 43. A coil spring 46 is provided underneath said upper clutch member to urge said clutch member upwardly to be always at its normal released position.

Figure 8:
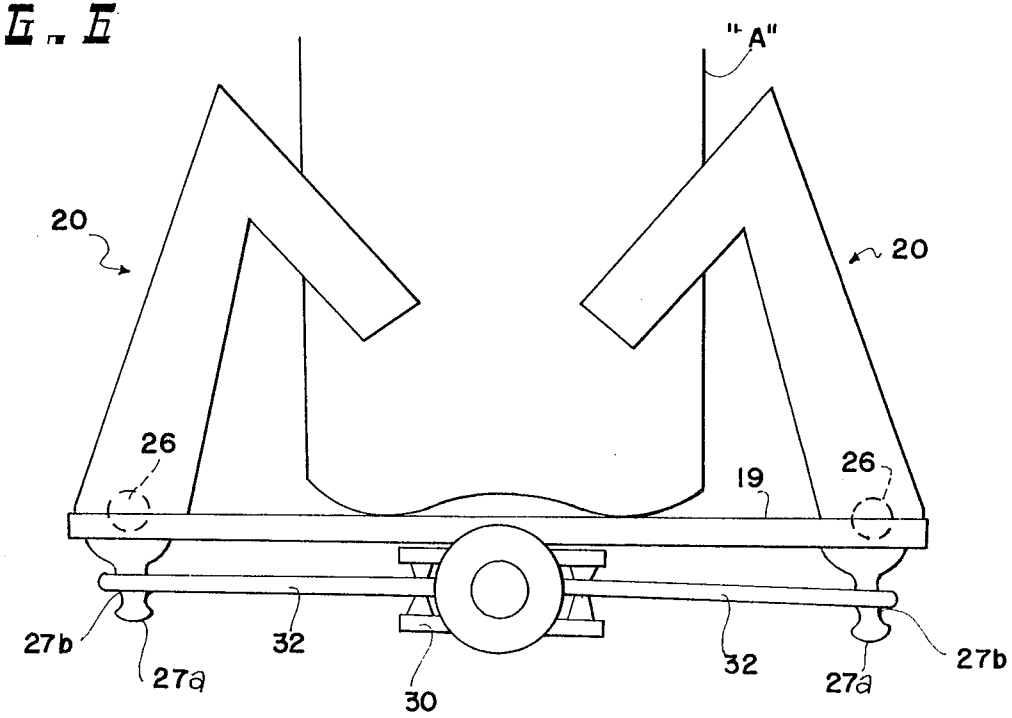
FIG. 8 is a perspective view of a clutch-switch lever mechanism.

The clutch switch lever mechanism 18 (FIG. 8) comprises a clutch switch actuator "C" consisting of a horizontal pivot rod 47 pivotally supported on the side wall 13 by the bushing supports 47a, said pivot rod provided with a pair of spaced L-shape fingers 48 with rollers 48a at the ends thereof adapted to normally rest on top of the upper clutch member 45, and an L-shape main lever 49 fixedly secured at the outer end of said pivot rod. On top of the horizontal leg 49a of said main lever are clutch switch levers 50 and reversing clutch switch lever 51. Said levers are adapted to actuate the main lever 49 to rotate the pivot rod 47 when pressed to thus press the upper clutch member 45 downwardly by the rollers 48a, and cause said clutch member to frictionally engage with the clutch lining 41a of the lower clutch member 41. The clutch switch levers are adapted to simultaneously actuate a conventional reversible switch through their respective switch contact points 52 and connect to the reversible motor "M" through conventional wiring systems.

Figure 9:
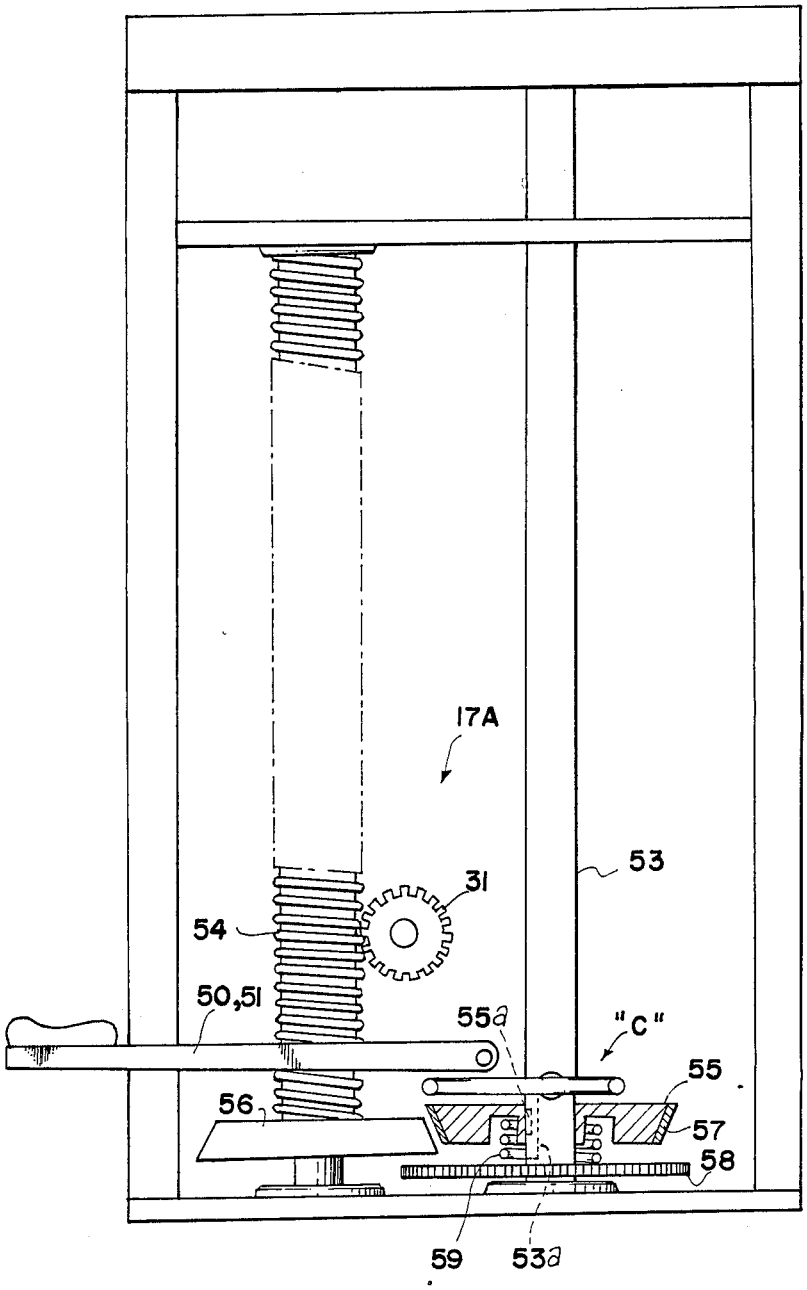
FIG. 9 illustrates another embodiment of the driving mechanism used in FIG. 1.

In the embodiment shown in FIG. 9, the driving mechanism 17A comprises a pair of parallely disposed unthreaded shaft 53 and a helically threaded shaft 54 journalled for rotation at the lower and upper ends thereof. The unthreaded and threaded shaft 53 and 54 are provided with frusto-conically shaped co-acting clutch members 55 and 56, respectively. The clutch member 55 provided with a clutch lining 57 has an integrated gear 58 adapted to mesh with the drive gear 42 of the reversible motor "M". Said clutch member 55 has a key 55a slidingly held on the keyway 53a of the threaded shaft, said clutch member being spring-biased by the coil spring 59 to urge said clutch member to be always at its normal released position. The threaded shaft 54 is positioned in such a manner that it meshes with the worm gear 31 of the actuating means 21 for the cramp members 20.

The clutch member 55 is adapted to be pressed downwardly by the clutch actuator "C" (FIG. 8) actuated by the clutch switch levers 50, 51, as previously described, to frictionally engage said clutch member 56 against the clutch lining of the clutch member 55. By so doing, the threaded shaft 54 rotates with the unthreaded shaft 53 which in turn is driven by the gear 42 of the motor "M" to rotate the worm gear 31 of the actuating means 21.

OPERATION

Figure 3:
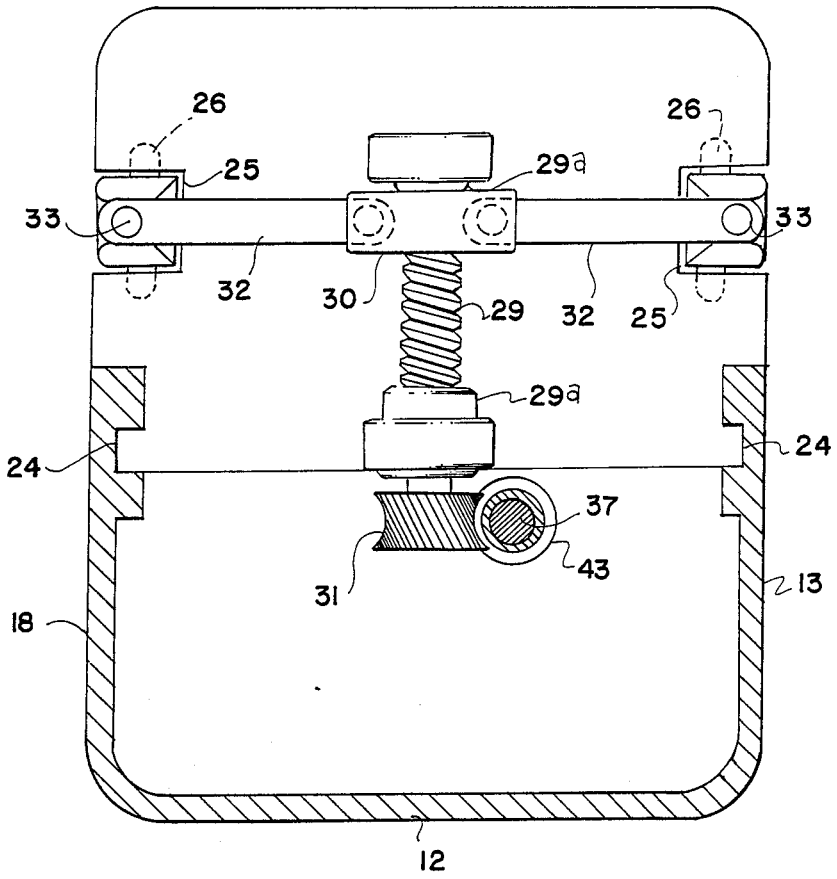
FIG. 3 is a cross-sectional view taken along line A—A of FIG. 1 showing the bottle body cramping unit with a pair of ram arms disposed in a straight position.
Figure 4:
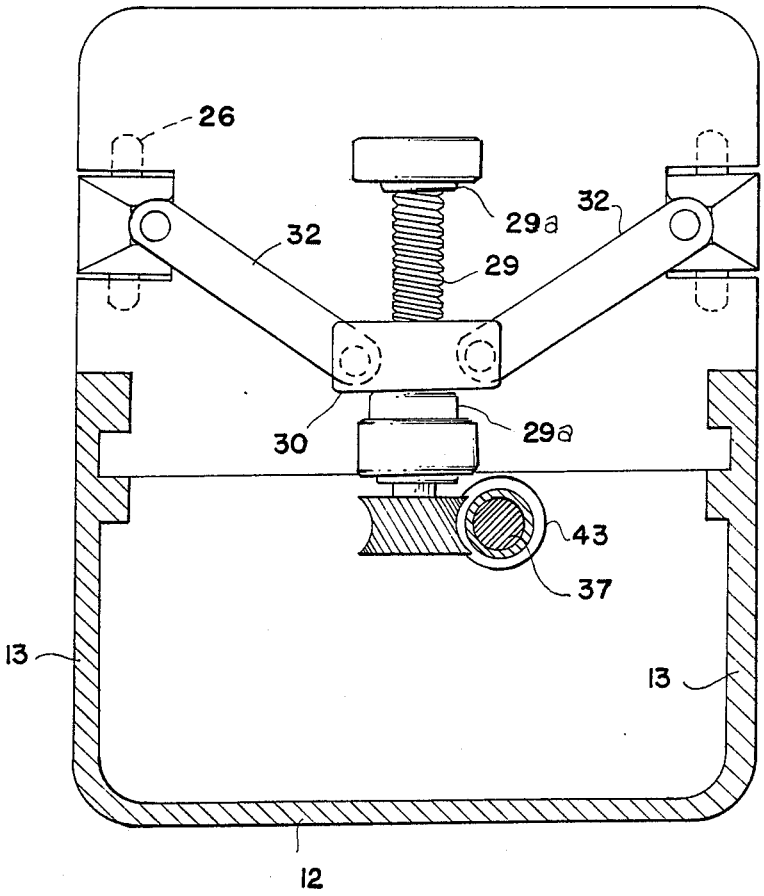
FIG. 4 is a view similar to FIG. 3 but showing the pair of ram arms in angular position.
Figure 5:
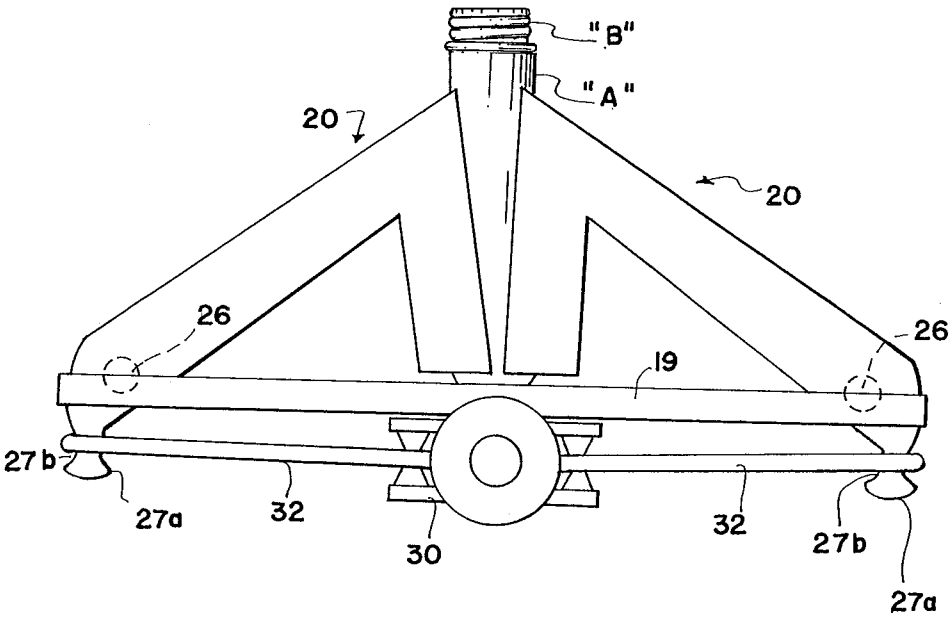
FIG. 5 is a front view of the bottle body cramping unit showing the vise jaws positioned to clamp a small-size bottle.

To start, press the reversing clutch switch lever 51 to rotate the reversible motor "M" in a counter clockwise direction. With the clutch switch lever 51 in its pressed position, the upper clutch member 45 is forced downwardly by the rollers 48a to frictionally engage against the clutch lining of the lower clutch member 41 to rotate the helically threaded hollow shaft 43 counter clockwise (when viewed from the bottom) and thus driving the worm gear 31 to simultaneously rotate also counter clockwise (when viewed from the worm gear end). By the helical action of the horizontal threaded shaft 29, the threaded block 30 then moves inwardly towards the worm gear side. In effect, both ram arms 32 which previously formed a straight line (FIG. 3) has begun to form an angle (FIG. 4) thus resulting in the contracting action of the outer ends which connects the ram arms 32 to the lower ends 27a of the cramp members 20. Therefore, both lower ends 27a of said cramp members move closer to each other. Because of a lever action created by said cramp members, when the lower ends 27a comes closer to each other, the downwardly and inwardly inclined vise jaws 28 moves away from each other, thus forming a big space between said cramp members 20. When the threaded block 30 has reach the extended end of the bushing 29a, the threaded block 30 can not move anymore towards the worm gear side. As such, the worm gear 31 can not rotate further. With the clutch switch lever 51 still being pressed, the helically threaded shaft 43 still continue to rotate together with the driven shaft 37. Therefore, with the helical action of the threaded shaft 43, the worm gear is pushed down, thus the whole unit of the platform goes down until the guide members 22 reach the bottom of the grooves 24 and can no longer move further. But the driven shaft 37 keeps on rotating since the reversing clutch switch lever 51 is still being pressed. At this instant, slippage occur between the lower clutch member 41 and the upper clutch member 45 causing the loss of power transmitted by the clutch unit.

The reversing clutch switch 51 is then released and the bottle or jar to be opened is positioned on the space between the vise jaws 28, which is approximately at the center of the platform 19.

Press the clutch switch lever 50 to rotate the motor "M" clockwise. With the clutch switch lever in its pressed position, the upper clutch member 45 is again forced to frictionally engage against the clutch lining 41*a* of the lower clutch member 41 to rotate the threaded shaft 43 clockwise and the gear 31 to also simultaneously rotate clockwise. By helical action of the threaded shaft 29, the threaded block 30 then moves away from the worm gear side and the angle formed by the two ram arms 32 becomes less towards a straight line. Because of the ram action effect, the inwardly bent lower ends 27*a* of the cramp members 20 which are connected to the outer ends of said ram arms, moves away from each other. By the lever action caused by the cramp members, the lower ends move away from each other and the vise jaws 28 moves closer to the center of the platform thus approaching with each other until the V-shape vise jaws touches the side of the jar or bottle body. The ram action effect further moves the lower ends 27*a* of the cramp members away from each other thereby causing the vise jaws to have a stronger cramping effect on the bottle body. The jar or bottle body is held firmly between the vise jaws 28 by the elastic material 28*a*. Because of the identical V-shape vise jaws, both cramp members work simultaneously together to put the bottle at the center of the platform. The downwardly and inwardly inclined V-shape formation of the vise jaws renders said vise jaws capable of effectively clamping any shape of a jar or bottle, be it rounded, rectangular, oval or square shape.

With the clutch switch lever 50 still in its pressed position, the worm gear 31 which is driven by the helically threaded shaft 43 either continues to rotate or is being pushed up together with the platform 19, when said worm gear stops rotating. If the frictional resistance created by the actuating means 21 of the cramp members is smaller than the frictional resistance on the guide members 22, the worm gear 31 continues to rotate to impart a stronger cramping effect on the side of the bottle body. But, if the frictional resistance on the actuating means is greater than the frictional resistance on the guide members 22, worm gear 31 stops rotating. At this instant, the actuating means 21 together with the platform 19 is pushed up by the helical action of the threaded shaft 43 until the bottle cap "B" engaged with the bladed finger grips 36 of the bottle cap gripping unit 16 and continue to be pushed up until a firm grip on the bottle cap is attained and can no longer go up. But the threaded shaft 43 still continue to rotate the worm gear 31 to further tighten the bottle body anew and simultaneously pushing up the platform 19 to frictionally engage the bottle cap against the bladed grip fingers 36 to the extent that the blades of the grip fingers cut into the upper corner edge of the cap "B" and rotate it counter clockwise (when viewed from the top), thus, loosening the cap from the bottle.

With the clutch switch lever 50 still in its pressed position, when the total torque on the cramp members 20 plus the thrust on the grip fingers 36 against the platform is greater than the torque that the clutch unit 41, 45 can take, then the clutch member 45 slips, thus disengaging the threaded shaft 43 from the motor "M".

If the clutch slips before the cap is loosened, it means the friction in the clutch is too weak. In this case, increase pressure on the clutch switch lever and by further pressing it down by the finger will increase the friction, thus increasing the torque in both the clamping effect of the cramp members and the upward thrust of the platform against the grip fingers until the cap is turned loose. The clutch switch lever 50 is then released.

To unclamp the vise jaws 28, the reversing clutch switch lever 51 is pressed to rotate the motor counter clockwise. With the clutch switch lever 51 in its pressed position, the sequences of the movements and actions imparted on the clutch members 41, 45, the threaded shaft 43, the worm gear 31, the threaded shaft 29, threaded block 30, ram arms 32 and the vise jaws of the cramp members 20 are repeated as previously stated in the first paragraph under "Operation". As the platform 19 goes down, the cap "B" is left on the grip fingers 36. The platform further goes down until the guide members 22 reaches the lower end of the grooves 24. The vise jaws of the cramp members are now at their farthest position from each other. The clutch switch lever 51 is then released to stop the motor and simultaneously release the clutch.

The bottle is then removed from the platform.

While a specific embodiment is disclosed, the invention is of course not limited to this particular form but rather is applicable broadly to all such variations as fall within the scope of the appended claim.

I claim:

1. A bottle closure opener for use in screwtype bottle caps comprising:

(a) a housing with an open front consisting of a substantially square base, a rear wall, opposed side walls and a top wall;

(b) a bottle body cramping unit mounted on a vertically movable bottle platform, said cramping unit consisting of a pair of opposed identical cramp members pivotally mounted at the lateral mid-section of said platform, said cramp members each consisting of an upwardly extending stem having an inwardly bent rounded lower end extending downwardly of said platform, and at its upper end, a pair of diverging downwardly inclined vise jaws defining a V-shape formation, and means for actuating said cramp members mounted underneath said platform whereby said actuating means tends to move said vise jaws towards or away from each other;

(c) a drive mechanism consisting of a vertical driven shaft journalled on said base and top wall, said shaft provided with a large gear at its lower end and a small gear at its upper end, said large gear having an integrated lower clutch member provided with a clutch lining and adapted to be in mesh with the drive gear of a reversible motor; a helically threaded shaft telescopically received on said driven shaft and adapted to be drivingly connected to said means for actuating said cramp members, said shaft having an unthreaded lower portion with a keyway disposed vertically thereon;

(d) a spring biased upper clutch member telescopically received on said unthreaded portion of said threaded shaft and vertically aligned with said lower clutch member, said upper clutch member having a key adapted to be vertically slidable in said keyway;

(e) a bottle cap gripping unit comprising a gear train mounted on said top wall, said gear train being drivingly connected to said driven shaft and provided with bladed grip fingers positioned in coaxial alignment with the center between said cramp members; and (f) a clutch actuator pivotally supported on said housing and disposed on top of said upper clutch member, and a pair of clutch switch levers, each adapted to rotate said actuator to press downwardly said clutch member to frictionally engage said lower clutch member and simultaneously switch on said motor.

2. A bottle closure opener in accordance with claim 1, wherein said actuating means for said cramp members consists of a horizontal threaded shaft provided with a threaded block threadedly engaged thereon, said shaft being mounted at the longitudinal mid-section underneath said platform and provided with a worm gear at its free end thereof, and said threaded block provided with a pair of opposed ram arms pivotally supported thereon and adapted to freely receive at the ends thereof, the lower ends of said vise jaws whereby a rotation of said threaded shaft tends to move said vise jaws towards or away from each other.

3. A bottle closure opener in accordance with claim 1, wherein said bottle platform is slidably supported on the side walls by a pair of guide members fitted on respective grooves in a snug-fit relation thereto.

4. A bottle closure opener in accordance with claim 1, wherein said driven mechanism consists of an unthreaded shaft and a helically threaded shaft parallely disposed with each other and journalled for rotation at the lower and upper ends thereof, said threaded shaft adapted to be drivingly connected to said means for actuating said cramp members, both of said shafts provided with co-acting frusto-conically shaped clutch members at the lower ends thereof, the clutch member on said unthreaded shaft having an integrated gear adapted to be in mesh with the drive gear of said motor, and said clutch member on said unthreaded shaft being spring-biased and vertically slidable adapted to be pressed downwardly by said clutch actuator to rotate with said shaft and frictionally engage with the clutch member on said threaded shaft.

* * * * *